United States Patent [19]

Tateishi et al.

[11] 4,265,989

[45] May 5, 1981

[54] PHOTOSENSITIVE MEMBER FOR ELECTROPHOTOGRAPHY

[75] Inventors: Kazuyoshi Tateishi; Yasushi Hoshino, both of Yokosuka; Rikuo Takano, Zushi, all of Japan

[73] Assignee: Nippon Telegraph & Telephone Public Corporation, Tokyo, Japan

[21] Appl. No.: 37,508

[22] Filed: May 9, 1979

[30] Foreign Application Priority Data

May 22, 1978 [JP] Japan ..... 53/60017

[51] Int. Cl.[3] ..... G03G 5/04

[52] U.S. Cl. ..... 430/57; 430/58; 430/63; 430/66; 313/96

[58] Field of Search ..... 430/57, 58, 63, 66; 313/96

[56] References Cited

U.S. PATENT DOCUMENTS

| | | | |
|---|---|---|---|
| 3,003,867 | 10/1961 | Lerner | 75/121 |
| 3,003,869 | 10/1961 | Schaffert | 96/1 |
| 3,652,270 | 3/1972 | Yamashita | 430/63 |
| 3,801,966 | 4/1974 | Terao | 430/57 |
| 3,932,025 | 1/1976 | Lakatos et al. | 430/58 |

FOREIGN PATENT DOCUMENTS 833188 6/1980 United Kingdom .

*Primary Examiner*—Jack P. Brammer

*Attorney, Agent, or Firm*—Burgess, Ryan & Wayne

[57] ABSTRACT

A photoconductive member for electrophotography wherein an electric field is established across a light amplification layer comprising a first transparent electrode, a field-effect light-emitting layer, a second photoconductive layer and a second electrode after the first photoconductive layer has been uniformly charged when a light image impinges on the first photoconductive layer, the portion of the field-effect light-emitting layer corresponding to the light image emits light to the first photoconductive layer, whereby an electrostatic image is formed on the first photoconductive layer by both the light image impinged thereon and the light emitted from the field-effect light-emitting layer.

2 Claims, 6 Drawing Figures

PHOTOSENSITIVE MEMBER FOR ELECTROPHOTOGRAPHY

BACKGROUND OF THE INVENTION

The present invention relates to an extremely sensitive photoconductive member for electrophotography.

Materials for electrophotographic photoconduct members are Se, SeTe, ZnO, CdS and the like. A photoconductive member may be prepared by the vacuum evaporation of Se over an electrode. A ZnO photoconductive member is provided by applying fine crystals of ZnO dispersed in binder resins over an electrode. A CdS photoconductive member is provided by applying fine crystals of CdS dispersed in binder resins over an electrode and forming an insulating layer over the CdS layer.

In electrophotography, the photoconductive members prepared in the manner described above are used as follows. First the photoconductive member is uniformly charged, and a light image of an original to be reproduced is focused on the uniformly charged surface so that an electrostatic latent image may be formed. The latent image thus formed is developed with the toner, and the toner image is transferred on a suitable recording medium. Thus a copy is reproduced.

When an electrostatic latent image is formed, the photoelectric efficiency $\eta$ is given by $\eta=\Delta\sigma/Fo$ where Fo=a number of photons impinged on a unit area; and $\Delta\sigma$=the charge per unit area of the number of surface charge ions in response to the impingement of a light image.

The sensitivity of the photoconductive member is in general expressed in terms of the photoelectric efficiency defined above.

However the prior art Se, SeTe, ZnO and CdS photoconductive members have a photoelectric efficiency which is always less than unity. Furthermore it is not possible to increase their photoelectric efficiency to above 1.

U.S. Pat. No. 3,003,849 discloses a xerographic plate of high quantum efficiency of the type wherein over a base are formed an electrode, an electroluminescence layer, a transparent electrode layer and a photosensitive layer. When an ultra-violet light image is fucused on the base of this plate, the light is absorbed in the electroluminescence layer so that the carriers are excited. Under a high electric field produced by the surface potential, the excited carriers cause avalanche breakdown with the resultant increase in carriers. These carriers disappear after emitting light. Part of the light thus emitted is pumped into the photosensitive layer so that amplification of the incident light results. The exposure of this xerographic plate must be made with ultra-violet light; that is, no white light may be used in the exposure.

British Patent No. 833,188 discloses a light amplifier and storage device wherein a photoconductive layer and an electroluminescence layer are sandwiched between two transparent electrodes. However this device is used only for amplifying light by impressing AC voltage between the transparent electrodes. That is, the device is not used as a photosensitive member or plate.

SUMMARY OF THE INVENTION

Accordingly, one of the objects of the present invention is to provide an electrophotographic photosensitive member with the optical amplification capability for increasing the photoelectric efficiency higher than unity.

The present invention provides an electrophotographic photosensitive member comprising a first photoconductive layer which is uniformly charged and on which impinges a light image so as to form an electrostatic latent image, a light amplification layer consisting of a first transparent electrode, a field-effect light-emitting layer, a second photoconductive layer and a second electrode laminated in the order named, and a power supply means for impressing a potential between the first and second electrodes, whereby when a light image impinges on the first photoconductive layer, the portion of the field-effect light-emitting layer corresponding to the incident light image emits the light to the first photoconductive layer.

BRIEF DESCRIPTION OF THE DRAWINGS

FIGS. 3–5 depict the sectional views of the photosensitive layers the right side thereof being cut away in enlarged scale and each contraction scale may be different from one Figure to another.

DESCRIPTION OF THE PREFERRED EMBODIMENTS

Figure 1:
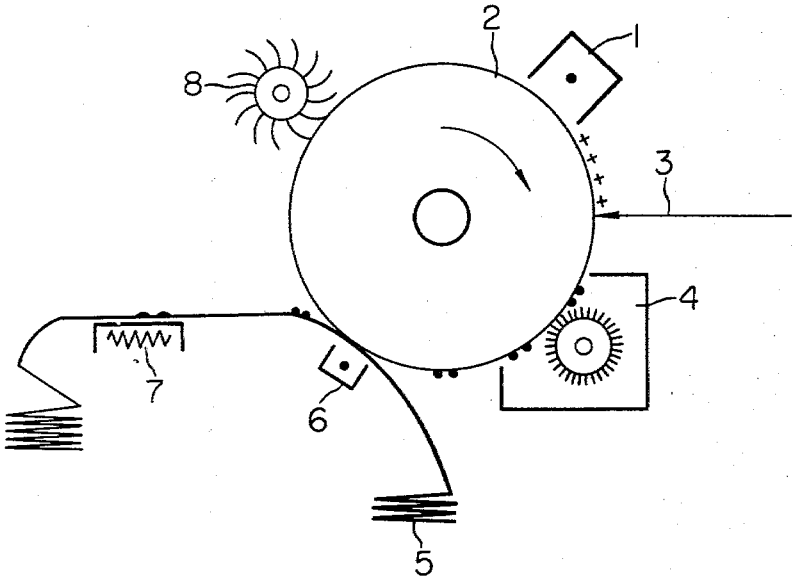
FIG. 1 is a view used for the explanation of the underlying principle of electrophotography.

In FIG. 1 is shown a schematic view of an electrophotographic copying machine based on the Carlson method. A photoconductive drum 2 is first uniformly charged by a charger 1, and a light image 3 of an original is focused upon the charged drum 2. The surface charge at an area of the drum where the light impinges disappears, whereby an electrostatic latent image is formed. The latent image is developed with the toner supplied from a developer 4, and the toner image is transferred to a copy sheet 5. The toner image thus transferred to the copy sheet 5 is fixed by a fixer 7. The toner still remaining over the drum after the image transfer is removed by a cleaner 8.

Figure 2:
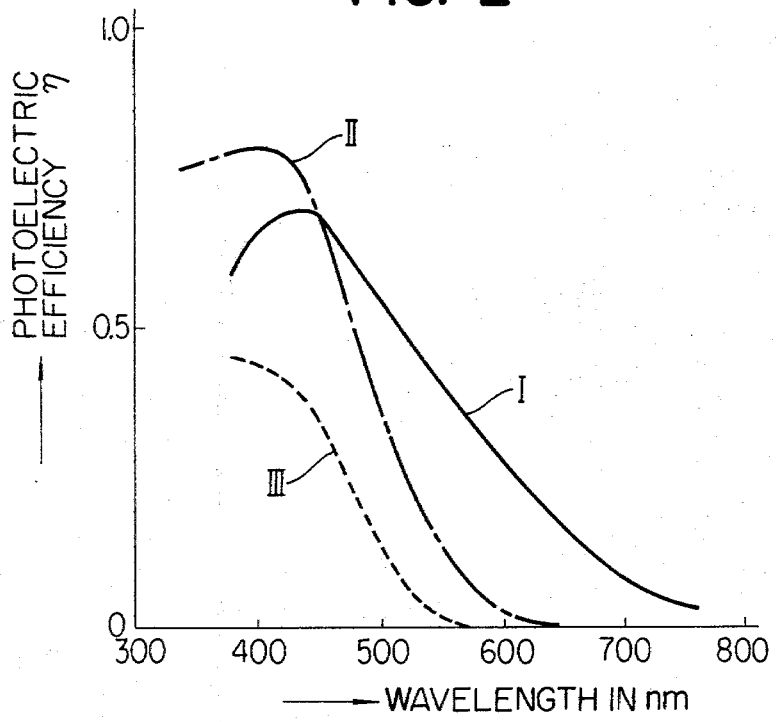
FIG. 2 shows the photoelectric efficiency—wavelength characteristic curves of some prior art photosensitive members available in the market.

The photoelectric efficiency $\eta$ of the photosensitive members available in the market used in the electrophotographic copying machines of the type described is shown in FIG. 2. The curve I indicates the photoelectric efficiency of CdS; the curve II, that of SeTe; and the curve III, that of a photosensitive member consisting of a layer of polyvinyl carbazole and a layer of Se. Since the photoelectric efficiency will never exceed unity, a large quantity of light is required for forming the light image 3.

Figure 3:
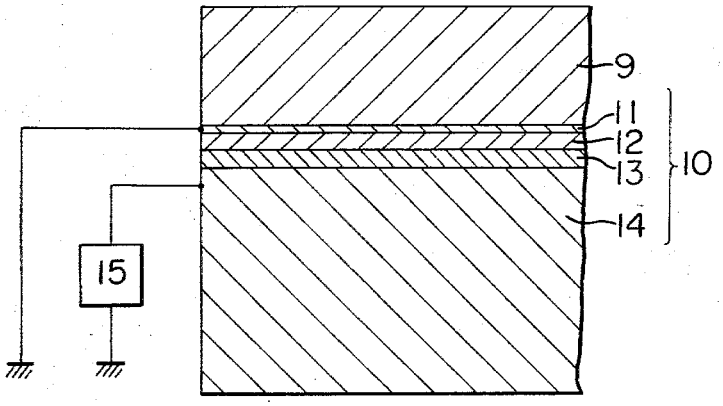
FIGS. 3–5 are schematic sectional views, on enlarged scale, of one parts of photosensitive members in first, second and third embodiments, respectively, of the present invention.

In FIG. 3 is shown a first embodiment of the present invention. As with the prior art photosensitive members, a first photoconductive layer 9 consists of Se, SeTe, CdS or ZnO and may be uniformly charged by a corona discharge or the like. A light amplification layer 10 consists of a transparent electrode layer 11, a field-effect light-emitting layer 12, a second photoconductive layer 13 and an electrode 14. The transparent electrode 11 is grounded while the electrode 14 is impressed with an AC or DC voltage from a voltage source 15.

In operation, the first photoconductive layer 9 is uniformly charged by a corona discharge or the like. Since the transparent electrode 11 is grounded, part of the light incident upon the first photoconductive layer 9 is absorbed in this layer as with the prior art photosensitive members. The unabsorbed light is transmitted through the first photoconductive layer 9, the transparent electrode 11 and the field-effect light-emitting layer 12 to the second photoconductive layer 13. The resistance of the second photoconductive layer 13 is lowered so that the electric field established between the transparent electrode 11 and the electrode 14 is concentrated in the field-effect light-emitting layer 12. As a result the field-effect light-emitting layer 12 is impressed with a step-like electric field so that the displacement current is generated which causes the field-effect light-emitting layer 12 to light for a short time interval. Part of the light emitted from the field-effect light-emitting layer 12 enters the first photoconductive layer 9. That is, the light which is transmitted through the first photoconductive layer 9 into the light amplification layer 10 is amplified and returned to the layer 9. Therefore the apparent photoelectric efficiency of the photoelectric member may be increased beyond unity. After the light emission by the field-effect light-emitting layer 12, the second photosensitive layer 13 resumes its initial state. The above operations is repeated whenever light impinges upon the first photoconductive layer 9.

The first photoconductive layer 9 has two opposed surfaces upon which the light image 3 and the light emitted from the field-effect light-emitting layer 13 incident respectively. Therefore in order to enhance the photosensitivity of the photoelectric member, it is preferable to form the first photoconductive layer 9 with a charge-transfer complex such as polyvinylcarbazole-trinitro fluorenon (PVCz-TNF) which is bipolar in charge transfer. However when a carrier generating layer is so extremely thin as in a PVCz/Se laminated photosensitive member so that part of the incident light is transmitted therethrough, it is not needed to form the first photoconductive layer 9 with bipolar materials.

The field-effect light emitting layer 12 must transmit the light from the first photoconductive layer 9 to the second photoconductive layer 13. The layer 12 may be formed from ZnS, ZnSe and the like. These materials may be deposited into a layer by the vacuum evaporation processes. Alternatively they may be dispersed into resin binders such as cyanocellulose so as to be applied on a base or substrate.

The first and second photoconductive layers 9 and 13 may be formed from the same materials. The first transparent electrode 11 may be made of CuI, $In_2O_3$ and like while the second electrode 14 may be made of Al or Cu.

A blocking insulation layer may be interposed between the first transparent electrode 11 and the field-effect light-emitting layer 12 or between the second photoconductive layer 13 and the second electrode 14. The blocking insulation layer may be made of polycarbonate resins, polyethylene terephthalate and the like.

The second electrode 14 may also be transparent by forming it from CuI, $In_2O_3$ and the like. After the first photoconductive layer 9 is uniformly charged, a light image may be focused upon the second transparent electrode 14 so that in addition to the light transmitted through the second photoconductive layer 13 and the field-effect light emitting layer 12, the light emitted from the layer 12 reaches the first photoconductive layer 9. That is, the light image is amplified. An electrostatic latent image is also formed on the first photoconductive layer 9.

Figure 4:
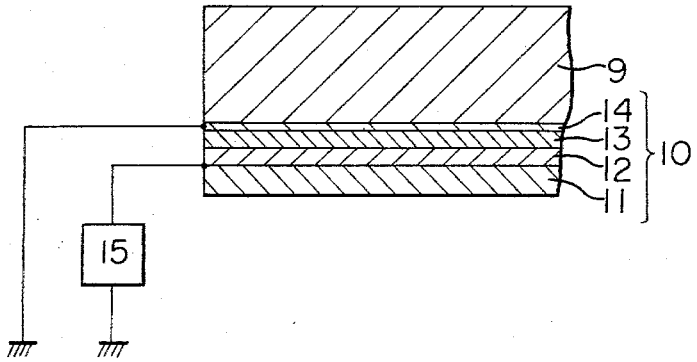

In a second embodiment shown in FIG. 4, the first transparent electrode 11, field-effect light emitting layer 12, second photoconductive layer and second transparent electrode 14 of the first embodiment are reversed in position, and the second transparent electrode 14 is grounded while the first transparent electrode 11 is connected to the voltage source 15. As with the first embodiment, a light image may be incident upon either the first transparent electrode 11 or the first photoconductive layer 9. In either case, the light is amplified by the field-effect light emitting layer 12 so that the apparent photoelectric efficiency may increase.

Figure 5:
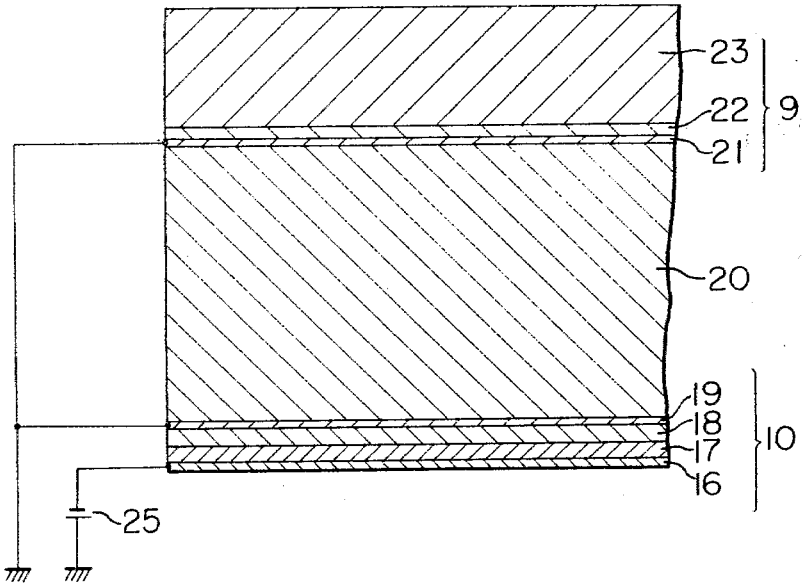

In a third embodiment shown in FIG. 5, the light amplification layer 10 consists of an electrode 16 made of Ag, a second photoconductive layer 17 mainly consisting of copper phthalocyanin, a field-effect light-emitting layer 18 made of Zns doped with Mn, electrodes 19 and 21 made of Al and a polyethylene terephthalate film 20. The first photoconductive layer 9 comprises a SeTe layer 22 formed by the vacuum evaporation process and a layer 23 mainly consisting of polyvinylcarbazole. The electrodes 19 and 21 are grounded and are equivalent in function to the first electrode shown in FIG. 3 so that the film 20 has no effects on the operation of the photosensitive member of the third embodiment. The film 20 is used to reinforce the structural strength of the photosensitive member.

The various layers of the photosensitive members in accordance with the present invention may be formed by the following process:

(i) Electrodes 19 and 21

They are formed by the vacuum evaporation process of Al to a thickness of about 100 A on both surfaces of the film 20.

(ii) Field-Effect Light Emitting Layer 18

The vacuum evaporation method is used to deposite Zns doped with Mn to a thickness of about two microns over the Al electrode 19. The field-effect light emitting layer has a resistivity of from $10^{12}$ to $10^{13}$ ohm-cm and an optical transmissivity of more than 60% in the long wavelength range higher than 500 nano meter.

(iii) Photoconductive Layer 17

$\beta$-form copper phthalocyanin is finely divided for 72 hours in a ball mill. Thereafter 5% by weight of 2-4-7 trinitrofluorenon is added and then the copolymers of vinyl chloride and vinyl acetate are added further in an amount of 4 times by weight as much as the mixture of $\beta$-form copper phthalocyanin and 2-4-7 trinitrofluorenone. The mixture is dissolved in methylketone and mixed and kneaded in a ball mill for 8 hours so as to prepare a photoconductive emulsion. Thus prepared emulsion is uniformly spread over the field-effect light emitting layer 18 by use of a doctor blade. Thereafter thus prepared semi-product is dried for two hours in a hot blast oven the interior of which is uniformly maintained at 150° C. Thus the second photoconductive layer 17 of a thickness between two and three microns may be obtained. The measurements of specimens show that the second photoconductive layer 17 has a resistivity of $10^{13}$ ohm-cm.

(iv) Ag Electrode 16

The Ag electrode 16 may be formed by the vacuum evaporation of Ag over the second photoconductive layer 17.

(v) First Photoconductive Layer 9

The first photoconductive layer 9 may be formed over the Al electrode 21 to a thickness of about one micron by the vaccum evaporation of SeTe (the Te contents=4%). Thereafter polyvinylcarbazole dissolved in tetrahydrofuran is uniformly applied over the SeTe layer by means of a doctor blade. Thereafter the semi-product is dried for 24 hours at room temperature. After drying, the thickness of the first photosensitive layer 9 is about 20 microns.

With the photosensitive members prepared in the manner described above, experiments were made. Both the Al electrodes 19 and 21 were grounded while the Ag electrode 16 was connected to the negative terminal of the DC power supply in such a way that the grounded side may have a positive potential. The photosensitive member was subjected to a corona discharge so as to obtain the surface potential of −1000 V and was exposed by a Xe flash lamp with an optical pulse duration of about 50 micro seconds so as to measure the decrease in surface potential.

Figure 6:
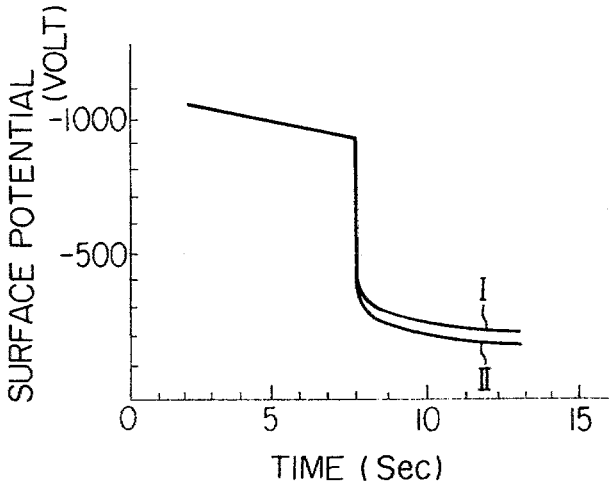
FIG. 6 shows the characteristic curves of the third embodiment shown in FIG. 5.

The results are shown in FIG. 6. The curve I shows the decrease in surface potential when the applied electric field was 0 V. The effects are substantially similar to those attainable by the prior art photosensitive members. However when the applied electric field was −300 V, the surface potential decreased remarkably as indicated by the curve II. This means that the sensitivity may be remarkably improved.

In summary, the photosensitive member in accordance with the present invention for electrophotography has the light amplification capability so that it has an extremely high sensitivity. Furthermore the amplification factor may be varied depending upon the strength of the electric field applied so that the sensitivity may be varied as needs demand. Moreover, the higher the frequency (of the incident light), the greater the quantity of the light emitted from the field-effect light-emitting layer becomes so that the effects of the present invention may be more pronounced in the case of exposures with high-speed pulses. In addition, it is not necessary to use single crystals in making the field-effect light-emitting layer so that the manufacturing steps may be much simplified. Thus when the photosensitive member of the present invention is used in an electrophotographic copying machine with pulse exposure means or in a high-speed printer with laser beam scanning means, the light source rating may be lowered and high-speed copying or printing may be attained.

What is claimed is:

1. A photosensitive member for electrophotography comprising (a) a first photoconductive layer which is uniformly charged and on which is focused a light image so as to form an electrostatic latent image, (b) a light amplification layer comprising
a first transparent electrode,
a field-effect light emitting layer,
a second photoconductive layer and
a second electrode laminated in the order named, and (c) DC power supply means for impressing a voltage between said first and second electrodes, said first photoconductive layer being attached to said first transparent electrode of said light amplification layer, whereby when a light image impinges upon said first photoconductive layer, the portion of said field-effect light emitting layer corresponding to said light image emits the light to said first photoconductive layer.

2. A photosensitive member for electrophotography comprising (a) a first photoconductive layer comprising
a SeTE layer formed by the vacuum evaporation of SeTe, and,
a polyvinylcarbazole layer, (b) a light amplification layer comprising
a first transparent electrode comprising polyethylene terephthalate having Al electrodes on both surfaces formed by vacuum evaporation,
a field-effect light transmitting layer comprising Zns doped with Mn,
a second photosensitive layer comprising copper phthalocyanin, and
a Ag electrode, and (c) power supply means for establishing a DC electric field between said first transparent electrode and said Ag electrode.

* * * * *